United States Patent [19]

Arai

[11] Patent Number: 4,787,762

[45] Date of Patent: Nov. 29, 1988

[54] POWER TRANSMISSION APPARATUS

[75] Inventor: Kenichiro Arai, Suwa, Japan

[73] Assignee: Seiko Epson Corporation, Tokyo, Japan

[21] Appl. No.: 38,257

[22] Filed: Apr. 14, 1987

[30] Foreign Application Priority Data

Apr. 16, 1986 [JP] Japan ..... 61-87630

[51] Int. Cl.[4] ..... B41J 23/00

[52] U.S. Cl. ..... 400/187; 192/33 R; 192/84 R

[58] Field of Search ..... 400/185, 187; 192/28, 192/33 R, 33 C, 84 B, 84 C, 84 R, 84 T, 108

[56] References Cited

U.S. PATENT DOCUMENTS

| | | | |
|---|---|---|---|
| 3,799,305 | 3/1974 | Limberger | 192/33 R |
| 4,436,031 | 3/1984 | Hori | 400/185 |
| 4,632,581 | 12/1986 | Ito et al. | 400/187 |
| 4,707,154 | 11/1987 | Arai | 400/185 |
| 4,716,783 | 1/1988 | Hayashi | 192/33 R |

FOREIGN PATENT DOCUMENTS

| | | | |
|---|---|---|---|
| 99674 | 6/1985 | Japan | 400/187 |
| 104365 | 6/1985 | Japan | 400/185 |
| 104372 | 6/1985 | Japan | 400/187 |

*Primary Examiner*—David A. Wiecking
*Attorney, Agent, or Firm*—Blum Kaplan

[57] ABSTRACT

An apparatus for controlling the transmission of power from a motor to a number of devices at selected times utilizes a single trigger mechanism which is operated at predetermined times in an operating cycle. The trigger mechanism controls a plurality of clutch mechanisms which transmit the power to the devices. The clutch mechanisms are locked against operation at times when they are not selected for operation.

22 Claims, 12 Drawing Sheets

POWER TRANSMISSION APPARATUS

BACKGROUND OF THE INVENTION

The present invention relates to a power transmission aparatus using a clutch whose output rotational angle can be preset. More particularly, the invention relates to a power transmission apparatus in which the timing of energizing an electromagnetic clutch control is such as to stop the clutch at a predetermined position.

A veriety of clutch mechanisms are known and used in printers and the like for control of paper feed, change of ribbon color, card feed, operation of a stamp or cutter, and the like. However, each known clutchmechanism, when used with others in the same machine, has its own electromagnetic trigger and, therefore, operates separately. Thus, a priter having a plurality of clutch-controlled functions is inevitably bulky, complicated in structure, and expensive.

SUMMARY OF THE INVENTION

Generally speaking, in accordance with the invention, a power transmission apparatus having a continuously rotating motor, a trigger means actuated at at least a first and a second time, first and second control means selectively driven by the rotational power of said motor at the first and the second time, a control member moved into engagement with the second control means to lock the latter at the first time and moved out of engagement therewith for releasing the second control means to allow the latter to be driven by the rotational power of said motor at the second time, and a locking member for controlling the control member such that the control member locks or releases the second control means, is provided.

Accordingly, it is an object of the present invention to provide an improved power transmission apparatus in which a plurality of clutches is controlled by a lesser number of electromagnetic triggers. It is another object of the invention to provide a power transmission apparatus in which one electromagnetic trigger is capable of controlling operation of a plurality of clutches at different times.

Another object of the invention is to provide an improved power transmission apparatus in which the use of costly and relatively large electromagnetic triggers is substantially reduced.

Still another object of the invention is to provide a simple power transmission apparatus which is reduced in size and cost.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

PREFERRED EMBODIMENTS OF THE INVENTION

Figure 1:
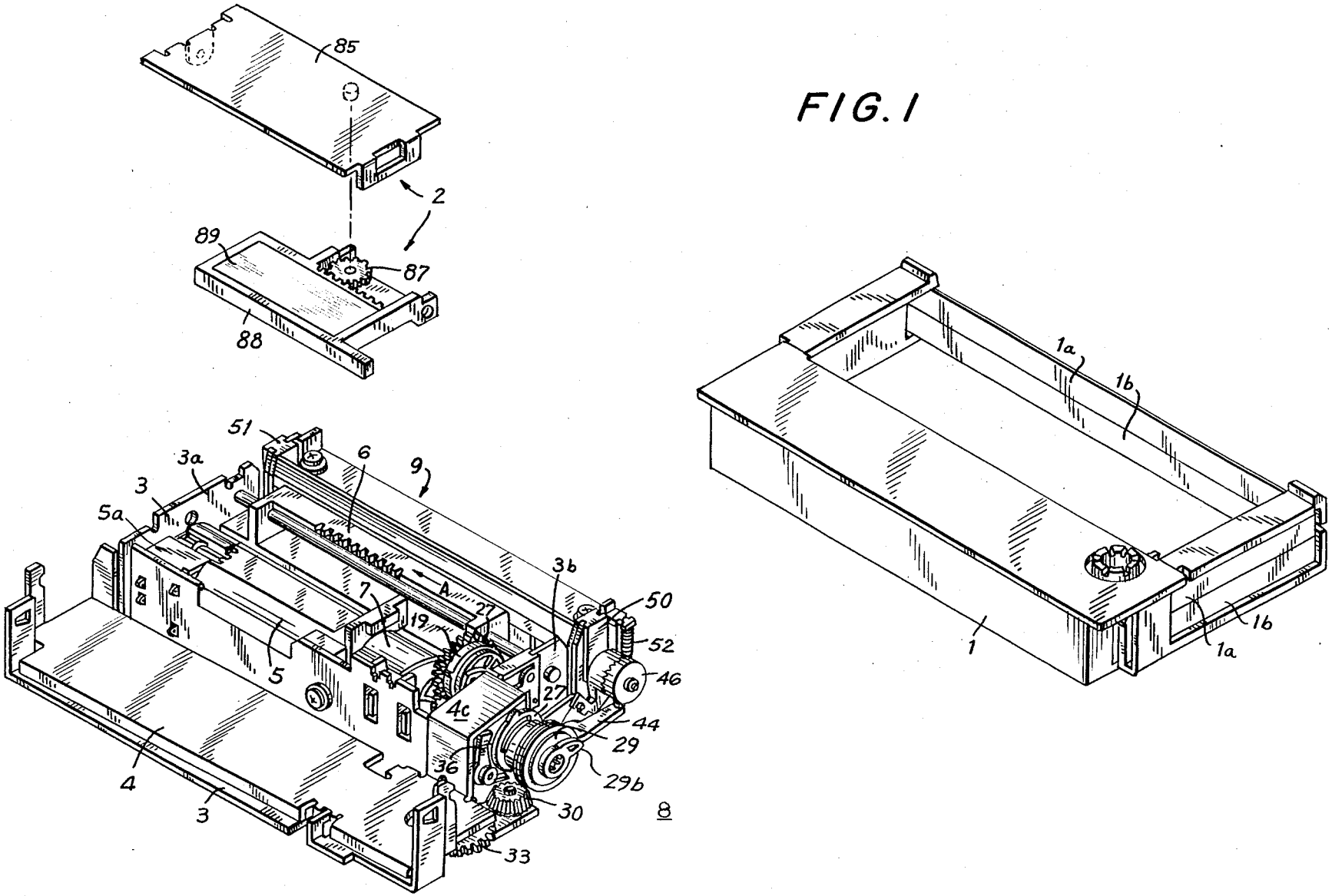
FIG. 1 is a perspective view of a dot impact shuttle printer having a power transmission in a first illustrative embodiment of the present invention.

A first embodiment in which the teachings of the present invention are employed in a dot-impact shuttle printer is shown in perspective in FIG. 1, with its ribbon cartridge unloaded. Ribbon cartridge 1, shown separately, has an upper ink ribbon 1a and a lower red ink ribbon 1*b*. Also shown separately is a balancer 2. Printer 1 includes a ribbon cartridge support 4 on which ribbon cartridge 1 can be mounted by means of a snap fit (not shown), motor 5, a print head 6 which is movable by a barrel cam 7 in the direction of arrow A, and back along a print line between end walls 3*a* and 3*b* of main frame 3, control 8 for controlling paper feed, ribbon feed and ribbon color change, and a paper guide 9.

Printer drive motor 5 (see also FIG. 2) has a tacho-generator 5*a*, at one end, which generates a pulse in synchronism with a rotation of motor 5 and, at the other end, a motor output gear 10 which is press-fitted onto motor output shaft 5*b*. Motor 5 is secured to a motor holder 12 by means of screws 14 and positioned thereby so that motor output gear 10 meshes with a reduction gear 11. Reduction gear 11 is rotatably supported on motor holder 12 by means of a shaft 13. Motor holder 12 has a projecting portion 12*b* which is seated in a notch 3*d* in bent-up frame part 3*c* of frame 3, and is fastened thereto by a screw 16 which first passes through a wiring board 15 and then is affixed to frame part 3*c*. The wiring board also engages projection 3*c*. Terminals 5*d* of motor 5 and terminals 5*c* of tacho-generator 5*a* extend through holes 15*b* and 15*a* respective to board 15 for soldering (not shown). Barrel cam 7 has a peripheral cam groove 7*a*, a longitudinal external recess 7*b* into which a reset detection signal plate 18 is fitted, and an internal gear 7*c* which meshes with reduction gear 11*a* when gear 11*a* and barrel cam 7 are both in position on the side of motor mount 12 which faces away from motor 5. Barrel cam 7 is press-fitted onto a cam shaft 17 which has oppositely disposed parallel plane surfaces.

A trigger yoke holder 19 which is fixed to cam shaft 17 and rotates therewith, has a gear portion 19*a* and a recess into which a trigger yoke 20, of magnetic material, is press-fitted. A trigger coil 21, rotatably mountd on cam shaft 17, has connecting terminals 21*a* which extend through holes 15*c* and are soldered to board 15. A trigger plate 22, made of magnetic material, is also rotatably mounted on cam shaft 17. Trigger plate 22 has a plurality of holes 22*a* which receive matching pins 24*a* of a trigger lever 24, being spaced therefrom by a compression spring 23. Trigger lever 24 is urged in the direction of arrow B by a torsion coil spring 25 which surrounds spring 23 and which engages an end face of trigger yoke 20. A cam shaft support member 26 rotatably supports cam shaft 17 and a paper feed cam 27 is slidably mounted on cam shaft 17 and rotates therewith. Paper feed cam 27 is urged in the axial direction (arrow C) by a compression spring 28 which seats on a face of a ribbon drive gear 29. Cam 27 has five distinct cammin surfaces 27*a*, 27*b*, 27*c*, 27*d*, 27*e*, (FIG. 3) on its outer periphery or on an end face. Ribbon drive gear 29 is mounted on cam shaft 17 for rotation therewith and has a helical gear 29*a* on its periphery and a cam 29*b* on its outer end face. One end 17*a* of cam shaft 17 is received in, and supported by a portion 12*a* of motor holder 12. Cam support member 26 is seated in a cut-out portion 3*f* of frame part 3*b*.

Figure 2:
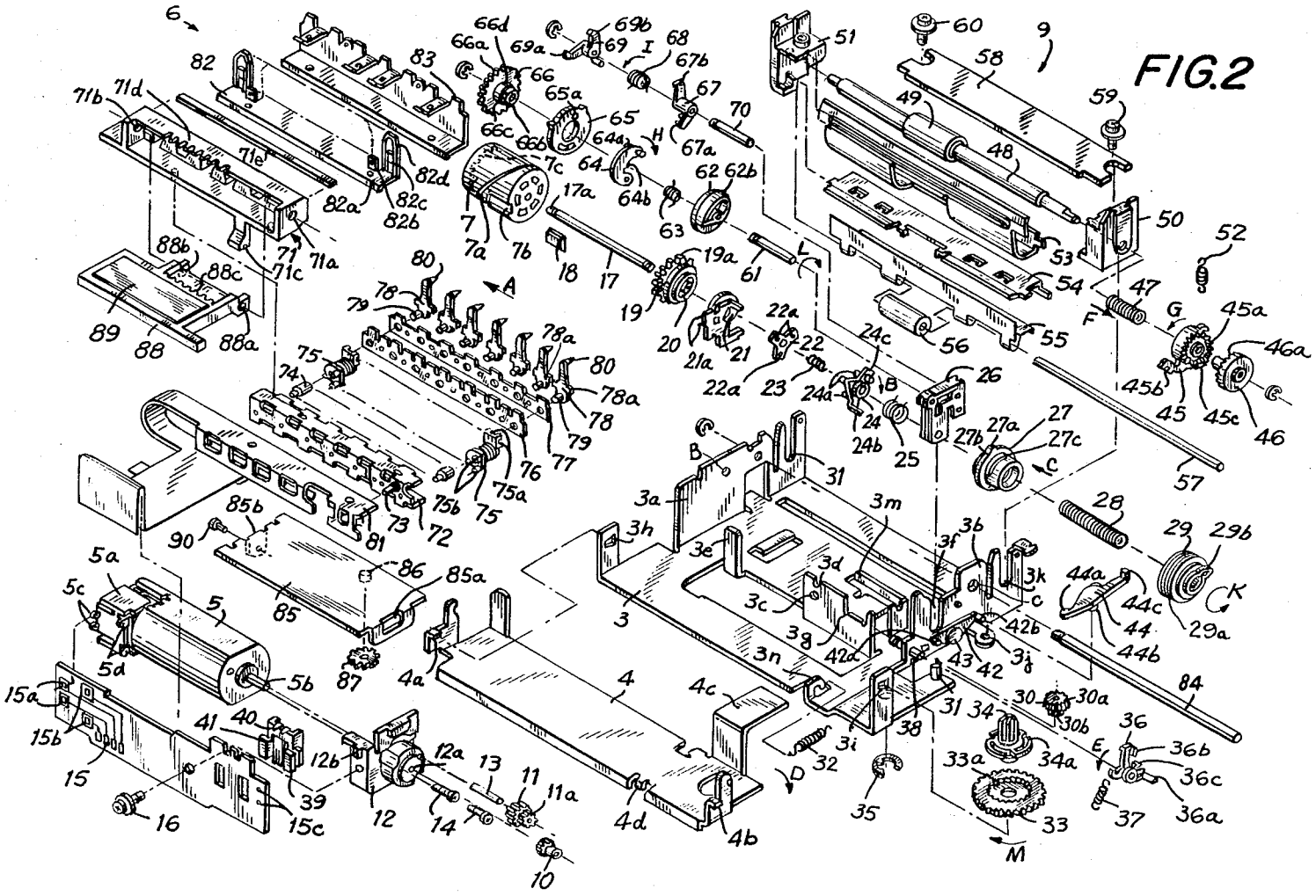
FIG. 2 is an exploded perspective view of the printer of FIG. 1.
Figure 6:
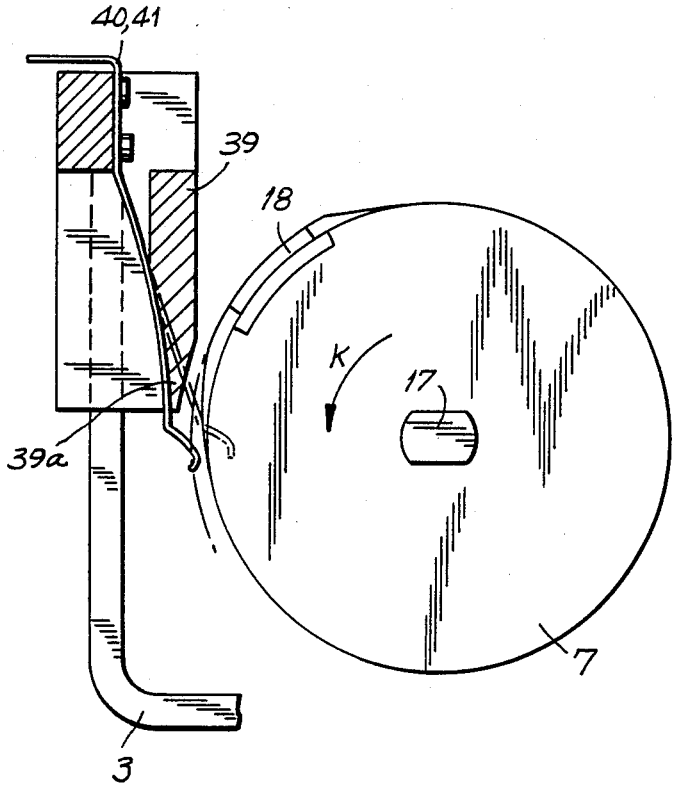
FIG. 6 is a sectional elevational view of the reset signal detecting mechanism of the printer of FIGS. 1 and 2.

A pair of reset detection signal brushes 40, 41 (FIG. 6) are attached to a holder 39 (FIG. 6) which seats in a cut-out portion 3*g* of frame part 3*c* (FIG. 2). Reset detection signal plate 18 (FIG. 6) projects outward of the peripheral surface of barrel cam 7 so that detection signal brushes 40, 41, which have been bent from their original condition by a portion 39*a* of holder 39, can only come into contact with detection signal plate 18 during rotation of head-moving cam 7.

A ribbon conveyinga gear 30 (FIG. 2) has a bevel gear portion 30*a* which meshes with ribbon drive worm gear 29*a* and a spur gear portion 30*b* which meshes with a ribbon take-up gear 33, and is rotatably mounted on a vertical shaft 31 which is fixed to main frame 3. A take-up shaft 34 has a plurality of ratchet portions 34*a* which engage the ratchet wheel teeth 33*a* inside of ribbon take-up gear 33. The lower portion of take-up shaft 34 passes through ribbon take-up gear 33 and is rotatably fastened, on the other side of frame 3, by means of an E-shaped snap ring 35.

Figure 8:
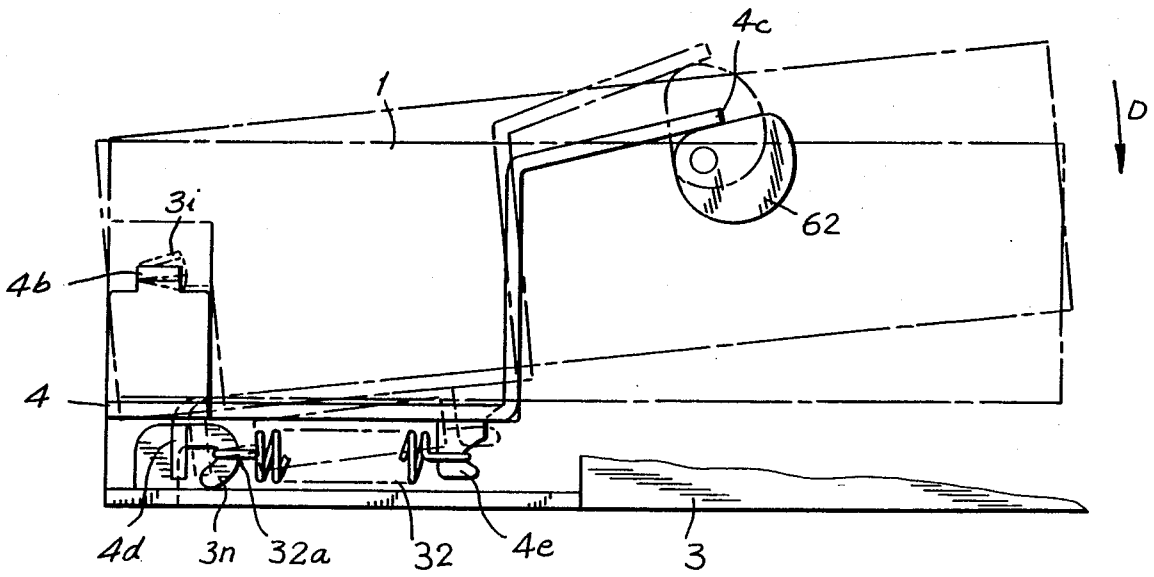
FIG. 8 is a schematic depiction of the ribbon color change operation of the printer of FIGS. 1 and 2.

Ribbon cartridge support 4 (FIGS. 2 and 8) has laterally protruding pivot portions 4*a*, 4*b* which are received in holes 3*h*, 3*i* of main frame 3, and is biased in the direction of arrow D (FIG. 2) by a tension spring 32 acting between a hook 3*n* on frame 3 and a hook 4*e* (FIG. 8) under ribbon frame 4. The amount by which ribbon cartridge support 4 pivots is regulated by a hook 32*a* of spring 32 and a depending tab portion 4*d* of cartridge support 4 (FIG. 8).

A paper feed cam lever 36 (FIG. 2, lower right and FIG. 3) carries axially-extending projections 36*a* and 36*b* which respectively engage cam portions 27*a* and 27*b* of cam 27, and a portion 36*c* (FIG. 2) which engages an axially projecting portion 24*b* of trigger lever 24. Paper feed cam lever 36 is rotatably mounted on a horizontal shaft 38 which is fixed on frame 3 and is biased in the direction of arrow E by a tension spring 37. A paper feed lever 42 having horizontal pins 42*a* and 42*b* is pivotally mounted on the side of frame 3 by means of a shaft 43. Pin 42*a* engages paper feed cams 27*d*, 27*e* (FIG. 3) and pin 42*b* engages in a notch 45*b* on a paper feed drive gear 45. Paper feed drive gear 45 has ratchet teeth 45*a* and is movably mounted on paper feed shaft 48, being biased axially in the direction of arrow F (FIG. 2) by a compression spring 47 and rotationally in the direction of arrow G by a tension spring 52. Ratchet teeth 45*a* mesh with oppositely facing ratchet teeth 46*a* on the opposing end face of a paper feed gear 46. Paper feed gear 46 is secured on the end of paper feed shaft 48. The central part of paper feed shaft 48 supports a paper feed roller 49; the shaft itself is supported at opposite ends by bearing members 50 and 51 which, in turn, are mounted in slots 3*l* and 3*k* of main frame 3. A release lever 44, pivotally supported by a pin 44*b* on a projection 3*j* of main frame 3 has a longitudinal projection 44*a* which contacts paper feed cam 27*c*, and a vertical pin 44*c* which contacts a raised cam portion 45*c* on the outer face of paper feed drive gear 45.

An internal paper guide 53 and an external paper guide 54, the latter provided with an auxiliary paper guide plate 55, are supported above main frame 3 by bearing members 50 and 51. Auxiliary paper guide plate 55 is made of resilient material and supports a paper press spring bar 57 which carries a paper pressure roller 56. A platen plate 58 is fixed between the upper portions of bearing members 50 and 51 by screws 59 and 60.

Figure 4:
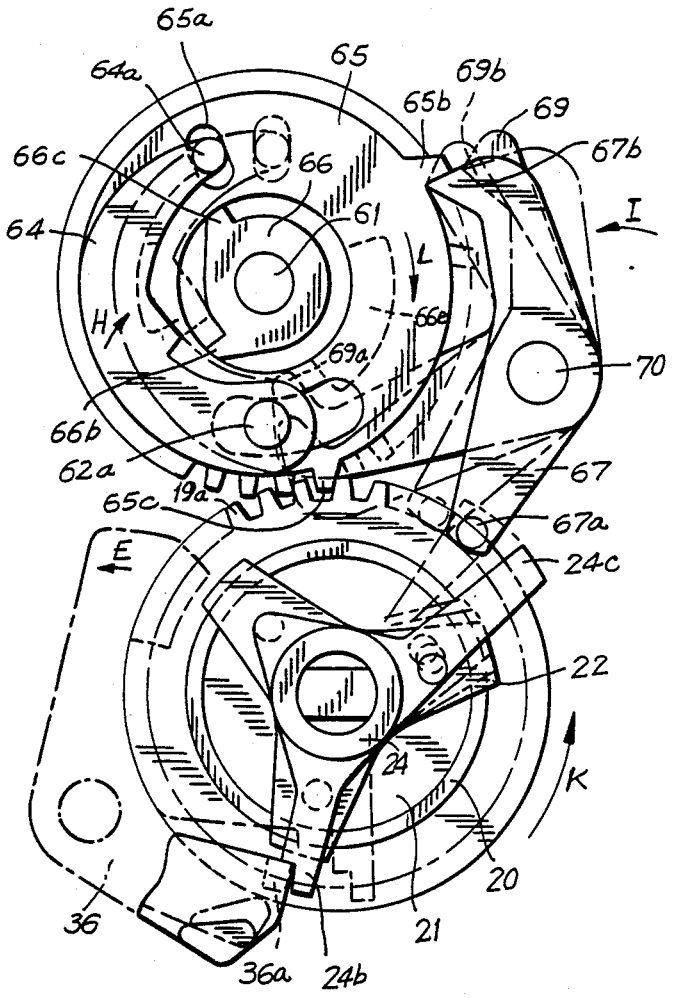
FIG. 4 is an elevational view of the trigger and ribbon color change mechanism of the printer of FIGS. 1 and 2.

A switch clutch shaft 61 and a clutch lever shaft 70 are press-fitted in holes of cam support member 26 and extend parallel to cam shaft 17. Switch clutch shaft 61 passes in turn through a switch cam 62, a clutch pawl spring 63, a clutch plate 65 having a hole 65*a* into which a pin 64*a* of a clutch pawl 64 is fitted, and a clutch gear 66. One face of switch cam 62 has a cam 62*b* which contacts cam follower portion 4*c* of ribbon cartridge support 4 and, on its other face (FIG. 4), an axially projecting pin 62*a* on which clutch pawl 64 is pivotally mounted. Clutch pawl spring 63 biases clutch pawl 64 in the direction of arrow H. Clutch plate 65 has a radially extending through-hole 65*a*, and radially-extending projections 65*b*, 65*c* which divide the outer circumference of clutch plate 65 into unequal portions. Clutch gear 66 includes radial teeth 66*a* which mesh with the teeth of gear 19*a* on yoke holder 19, an axially extending cylindrical portion 66d on which clutch plate 65 is rotatably mounted, a pair of pawls 66*b*, 66*c* which can engage a pawl portion 64*b* of clutch pawl 64, and, on the other end face (FIG. 4), a cam 66*e* which can be engaged by a tip portion 69*a* of a switch control lever 69.

Clutch lever shaft 70 passes through a clutch lever 67, a clutch spring 68, and clutch control lever 69. Clutch lever 67 has an axially extending pin 67*a* which can engage portion 24*c* of trigger lever 24, and a portion 67*b* which can engage projections 65*b*, 65*c* of clutch plate 65. Control lever 69 has a portion 69*a* which can engage cam portion 66*e* on the back of clutch gear 66, and a sharp-tipped portion 69*b* which can engage projections 65*b*, 65*c* of clutch plate 65. Clutch lever 67 and control lever 69 are respectively urged by clutch spring 68 in the direction of arrow I and in the opposite direction.

The structure of movable print head 6 is now described with reference to FIGS. 2 and 5. A pin 73 extends rearward from a yoke 72 of magnetic material to engage (FIG. 5) in groove 7*a* of barrel cam 7 and to receive motion therefrom. A plurality of fixed cores 74, facing in the other direction, are spaced apart on yoke 72 at equal distances (pitches) in the direction of head movement. Each core 74 carries a coil 75. A coil pressure plate 76 of magnetic material, a lubricating sheet 77, and a set of pring plates 78 are held against coils 75 and in contact with each other. Each print plate 78 carries a print pin 80 at one end for use in printing a dot on a print paper and carries an operating core 79 at the other end. Laterally extending portions 78*a* of each print plate 78 are rotatably received and supported in concave journal portions 75*a* (FIG. 2) which are supported on each coil 75. Yoke 72, fixed cores 74, operating cores 79 and coil pressure plate 76 constitute a plurality of magnetic circuits.

Yoke 72 is supported beneath a carriage 71 by means of a fixing spring plate 83, with the upper portions of a flexible printd circuit (FPC) 81 positioned between yoke 72 and carriage 71. The terminal pairs 75*b* of each coil 75 are soldered to various connecting leads in FPC 81.

Figure 5:
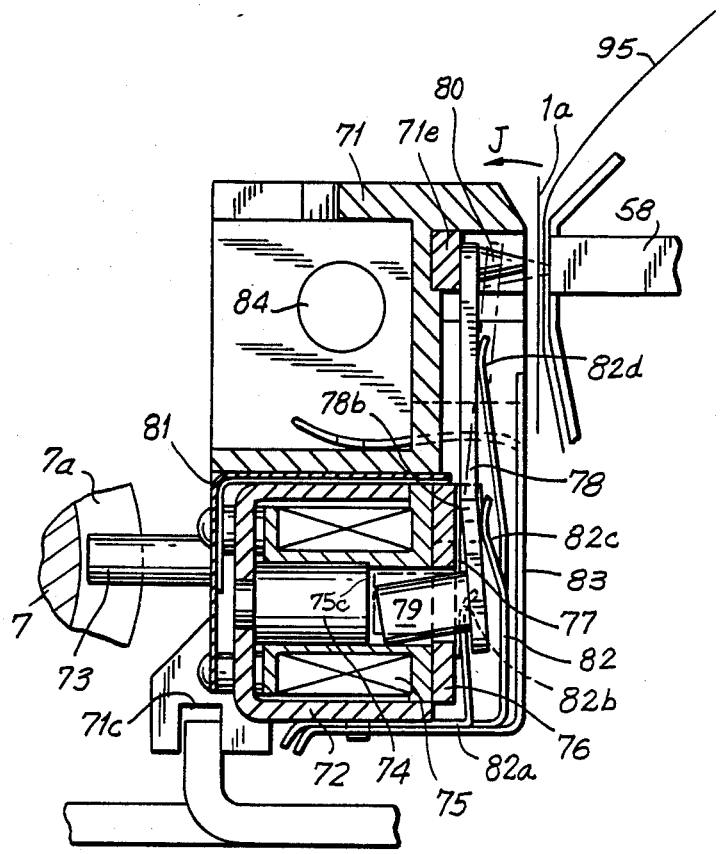
FIG. 5 is a sectional elevational view of the print head.

Carriage 71 is slidably mounted on a guide shaft 84 (FIGS. 2 and 5). The ends of shaft 84 are fitted into holes (B) and (C) of main frame walls 3*a* and 3*b* and the shaft passes through holes 71*a* and 71*b* in carriage 71. A depending portion 71*c* of carriage 71 slides on a guide portion 3*m* which is bent upwards out of main frame 3 and prevents rotation of carriage 71 about shaft 84.

An L-shaped leaf spring 82 (FIGS. 2 and 5) has a bottom portion 82*a* and a plurality of upper leaf portions 82*b*, 82*c* and 82*d*. Lower leaf portion 82*a* is fastened between yoke 72 and fixing spring plate 83. Each leaf portion 82*b* urges a stepped portion 75*c* provided on the inside of each coil 75 through lubricating sheet 77 and coil pressure plate 76 toward the respective fixed core 74. Each leaf portion 82*c* biases a pivot point 78*b* of the respective print plate 78 (FIG. 5) toward sheet 77, e.g. into journals 75*a*. Each leaf portion 82*d* urges the upper portion of a respective print plate 78 in the direction of arow J (FIG. 5), into contact with a damper 71*e* on carriage 71.

Balancer 2 (FIGS. 1 and 2) includes a balancer frame 88 and a balancer cover 85. Balancer frame 88 contains a weight 89 of a material such as lead and is slidably mounted, between holes 71*a* and 71*b* of carriage 71, on guide shaft 84 which passes through its guide holes 88*a*, 88*b*. Balancer frame 88 has a rack 88*c* which is coupled to a rack 71*d* on carriage 71 via intermediate balancer gear 87. Balancer gear 87 is pivotally mounted on a downward-extending shaft 86 on the under side of balancer cover 85. One end 85*a* of balancer cover 85 fits around a projection 12*c* on motor holder 12 for regulating movement of balancer frame 88 in rotation. The other end 85*b* of cover 85 is fixed to end wall 3*a* of main frame 3 by a screw 90.

In the foregoind embodiment, and as used in the below-appended claims, a "first control means" includes torsion coil spring 25, paper feed cam 27, compression spring 28, paper feed cam lever 36, and spring 37, while a "second control means" includes switch clutch shaft 61, switch cam 62. clutch pawl spring 63, clutch pawl 64, clutch plate 65, clutch gear 66, clutch lever 67, spring 68, control lever 69, and clutch lever shaft 70. A "trigger means" includes trigger yoke holder 19, trigger yoke 20, trigger coil 21, trigger plate 22, compression spring 23 and a trigger lever 24. As also used in the below appended claims clutch gear means 66 includes "cam means" 66*e* and "lever means".

Operation of the above-described control assembly is set forth in the following, with reference to the timing chart of FIG. 7.

(1) Initial setting

As depicted in FIG. 2, upon application of current to drive motor 5, cam 7, cam shaft 17, yoke holder 19, trigger yoke 20, paper feed cam 27 and ribbon drive gear 29 are all caused to rotate in the direction of arrow K by power transmitted via motor gear 10 and reduction gear 11, 11*a* to internal gear 7*c* of barrel cam 7. Clutch gear 66 is rotated in the direction of arrow L by gear 19*a* of yoke holder 19. Take-up shaft 34 is rotated in the direction of arrow M from ribbon drive worm gear 29 via ribbon-conveying bevel gear 30 and ribbon take-up gear 33. Print head 6 is moved in the direction of arrow A by the action of groove cam 7*a* of barrel cam 7 upon cam follower 73. At this time, as shown in FIG. 8, depending on the position of switch cam 62*b*, ribbon frame 4 is situated in position for printing black ink (solid line) or red ink (two-dot-and-dash line). Therefore, prior to printing, ribbon frame 4 will be set to whichever condition is desired.

Figure 9A:
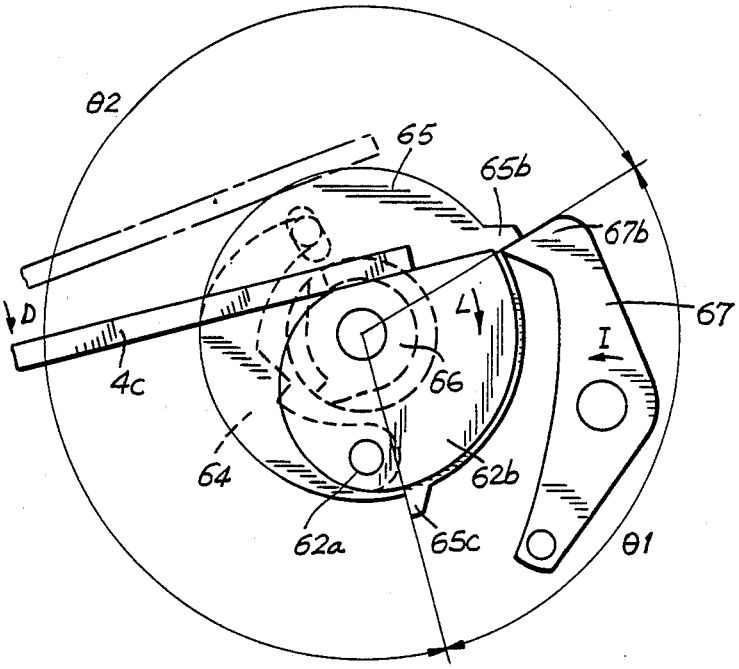
FIGS. 9*a* and 9*b* are elevational views illustrating operation of the clutch of the printer of FIGS. 1 and 2.
Figure 9B:
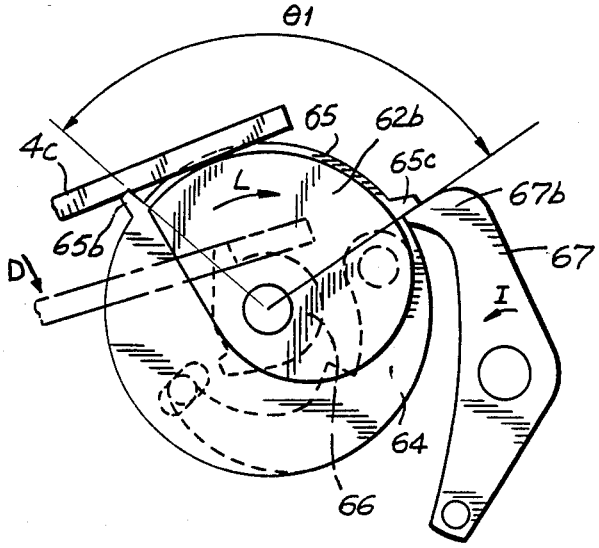

In the illustrative embodiment, ribbon frame 4 is positioned for printing black ink (the solid line position). The phase relationship between ribbon frame 4, switch cam 62, and clutch plate 65 is depicted in FIGS. 9*a* and 9*b*, where FIG. 9*a* depicts the black ink printing position of ribbon frame 4 and FIG. 9*b* depicts the position for printing red ink. In both FIGS. 9*a* and 9*b* it is seen that the radial projections 65*b* and 65*c* on the periphery of clutch plate 65 are spaced apart so as to divide clutch plate 65 into two sections, defined by angles $\theta 1$ and $\theta 2$ where $\theta 1+\theta 2=360°/n$, n being a positive integer. In FIG. 9*a*, tip portion 67*b* of clutch lever 67 is engaged with projection 65*b*, while cam follower portion 4*c* of ribbon frame 4 contacts the low lead portion of switch cam 62*b*. In FIG. 9*b*, tip portion 67*b* of clutch lever 67 has engaged projection 65*c* of switch clutch plate 65, and cam follower portion 4*c* of ribbon frame 4 contacts the high lead portion of switch cam 62*b*.

The manner of initial setting is described next in connection with the timing chart of FIG. 7.

Rotation of motor 5 causes tacho-generator 5*a* to generate a series of timing pulses 103. Meanwhile, the rotation of barrel cam 7 brings reset detection signal plate 18 into contact with reset direction signal brushes 40, 41, thereby causing generation of a reset pulse 102. Timing pulses 103 and reset pulses 102 are reference signals for all printer control signals.

When trigger coil 21 is energized by an externally generated trigger coil energizing pulse 111*a*, trigger plate 22 is attracted to trigger yoke 20, so that trigger plate 22 now also rotates in the direction of arrow K. Trigger lever 24, which is coupled to trigger plate 22 by pins 24*a*, now also rotates in the direction of arrow K, so that its projecting portion 24*c* (FIG. 4) contacts and moves clutch lever pin 67*a*, turning clutch lever 67 in the opposite direction to arrow I. Thereby lever portion 67*b* is disengaged from whichever of projections 65*b* and 65*c* of clutch plate 65 it has been engaged with. At the same time, control lever 69 is also disengaged from the same projection, 65*b* or 65*c*, of clutch plate 65. As a result, clutch platee 65 now rotates in the direction of arrow L, propelled by clutch pawl 64 as it moves in the direction of arrow H under compulsion of clutch pawl spring 63. The pawl portion of clutch pawl 64 is now engaged with pawl 66*b* or 66*c* of clutch gear 66 and transmits rotation of clutch gear 66 to switch cam 62.

When clutch plate 65, disengaged from clutch lever 67, is turned and clutch pawl 64 falls into the rotational locus of clutch gear 66, trigger coil 21 is deenergized. Clutch gear 68, clutch plate 65, clutch pawl 64, and switch cam 62 rotate further and clutch plate 65 is stopped when one of its projections 65*c* or 65*b* is engaged by tip portion 67b of clutch lever 67, the latter having already been returned to the standby position by deenergization of trigger coil 21. Clutch pawl 64 then rotates in the opposite direction to arrow H, and disengages from pawl 66b or 66c of clutch gear 66, whereby turning of switch cam 62, moving in association with clutch pawl 64 via pin 62a, is also stopped. The latter operation merely changes the condition shown in either FIG. 9a or FIG. 9b into the reverse condition, shown in the other figure.

Now, trigger coil 21 is energized again by a trigger coil energization pulse 111b. The interval of time between trigger pulses 111a and 111b is made longer than the time required for the rotation of clutch plate 65 through the smaller angle $\theta 1$ from trigger pulse 111a and shorter than the time required for its rotation through the larger angle $\theta 2$. Thus, the first energization of trigger coil 21 by trigger pulse 111a (FIG. 9a) allows clutch plate 65 to start and to continue rotation until projection 65c comes to the position of projection 65b. Since clutch plate 65 is rotating during this time, a second energization 111b of trigger coil 21 will be ineffective until switch clutch plate 65 is in the condition of FIG. 9b. If the first energization 111a of trigger coil 21 is carried out in the condition of FIG. 9b, switch clutch plate 65 starts and continues to rotate until projection 65b comes to the former position of projection 65c. Since the second energization 111b of trigger coil 21 is effected after passage of the time required for the rotation of switch clutch plate 65 through angle $\theta 1$, switch clutch plate 65 will stop in the condition of FIG. 9a. Thereafter, the second energization 111b of trigger coil 21 is effected to return clutch plate 65 to the condition of FIG. 9b.

Thus, clutch plate 65 is divided into at least two different angle $\theta 1$ and $\theta 2$ ($\theta 1 = \theta 2 = 360°/n$, where n is a positive integer), and trigger coil 21 is energized twice, so that switch cam 62 is inevitably initially set in the condition of FIG. 9a or of FIG. 9b. In the foregoing, it will be understood that the time of energization of trigger coil 21 is necessarily shorter than the time required for the rotation of clutch plate 65 through the smaller angle $\theta 1$.

It is to be noted that, in the illustrative embodiment, in order to set ribbon cartridge 1 in the black ink printing position, trigger coil 21 should be energized again to reinstate the condition of FIG. 9a after clutch plate 65 is locked against rotation. Note also that, by using multiples of projections 65b and 65c ($n \geqq 2$), more than one operating cycle can be provided for each rotation of clutch plate 65.

(2) Printing

Figure 10A:
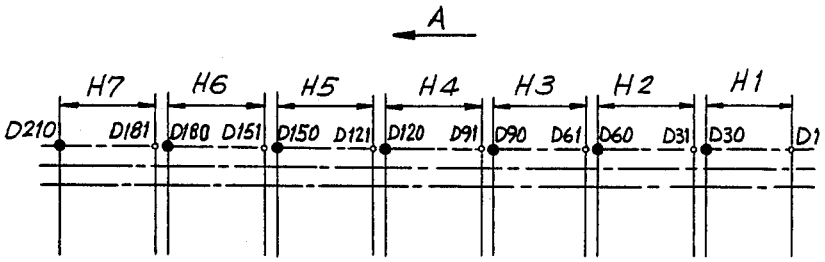
FIGS. 10*a* and 10*b* illustrate the print matrixes of the printer of FIGS. 1 and 2.
Figure 10B:
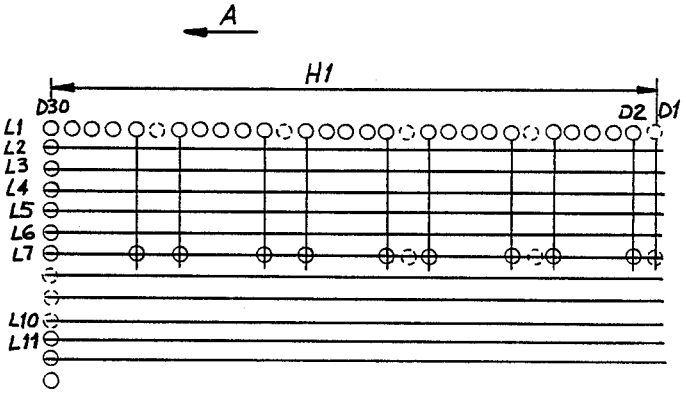

In the illustrative embodiment, the printed characters are in $5 \times 7$ dot-matrix form and have an inter-column spacing of one dot and a space between lines of three dots, as depicted in FIGS. 10a and 10b. Dots D1 to D210 are printed by the seven print pins 80 (FIG. 2), with 210 dots being printed on a single dot-line as shown in FIG. 10a. Each of the seven print pins 80 is moved along a respective line segment H1 to H7. FIG. 10b depicts the area printed by one print pin 80, showing how 30 dots, corresponding to 5 characters, can be printed along one segment of the line. Since print pins 80 are aligned in a single row along the print line, print paper 95 must be advanced perpendicularly to the print line in a series of dot-lines so as to complete a character. Accordingly, print paper 95 is fed seven times, from line L1 to line L7, to form a character in a $5 \times 7$ dot matrix.

(2-1) Printing of a single dot line

Figure 7:
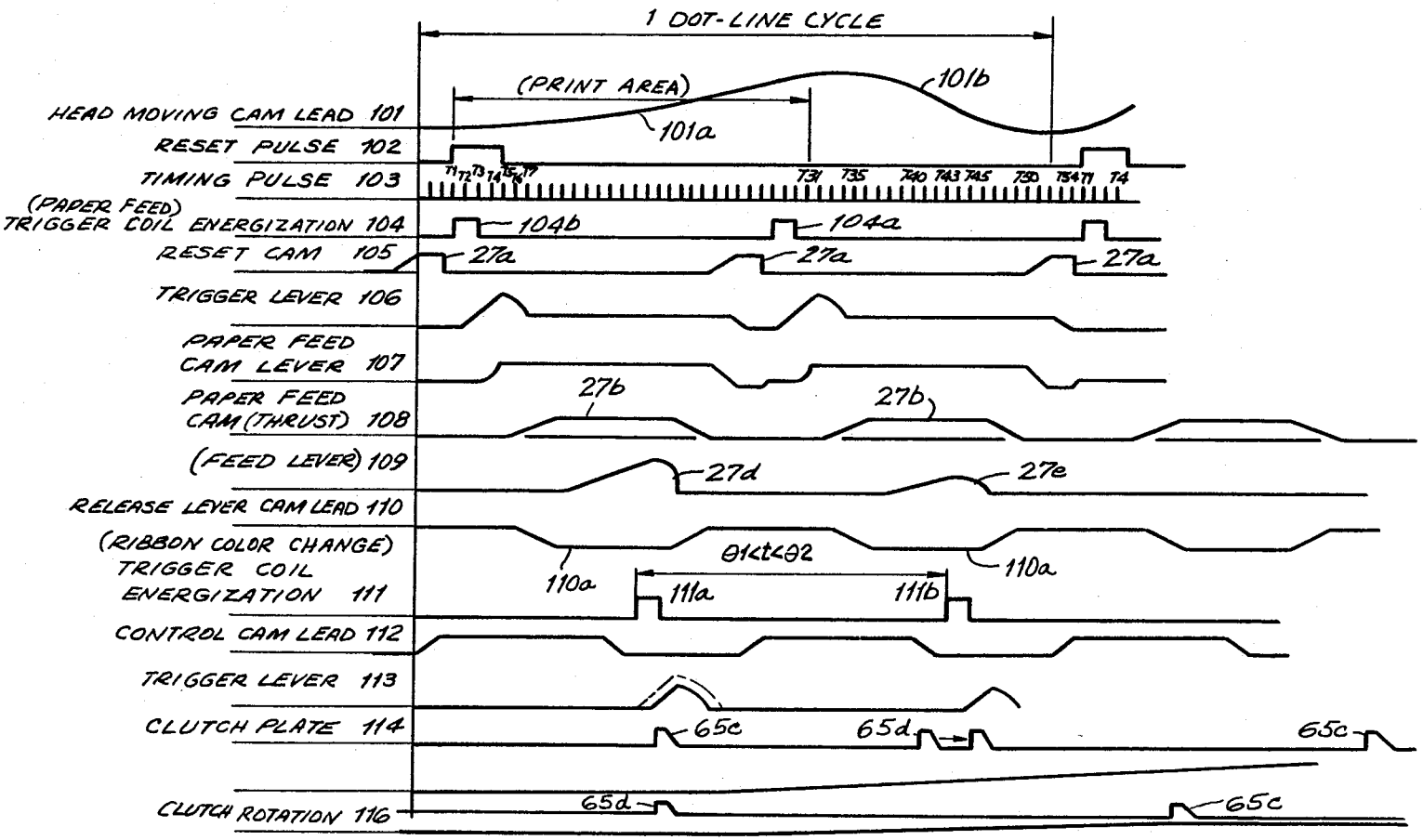
FIG. 7 is a chart showing timing of the operations of respective members of FIGS. 1 and 2, along with cam leads.

Referring again to the timing chart of FIG. 7, the lead 101 of cam groove 7a (barrel cam 7) has a straight line portion 101a which begins at the same time that reset pulse 102 is generated. The straight line movement produced by lead portion 101a corresponds to the distance moved by each print pin 80 across its respective print area, H1 to H7 (FIG. 10). If the timing pulse 103 generated immediately after the occurrence of reset pulse 102 is T1, then timing pulses T1-T30 correspond to dot positions D1-D30, D31-D60, D61-D90, D91-D120, D121-D150, D151-D180, D181-D210, respectively. When each of the seven coils 75 is energized at the generation of timing pulse T1, their operational cores 79 are attracted to fixed cores 74, turning print plates 78 about the respective pivot points 78b in the opposite direction to arrow J. As a result, print pins 80 strike toward platen 58 through ribbon 1a (or 1b) onto print paper 95, and seven dots D1, D31, D61, D91, D121, D151, D181 are printed on paper 95. To print a full line of dots D1-D210 on print paper 95, the operation is repeated until the occurrence of timing pulse T30. When characters are to be printed, the dots forming the characters are printed at appropriate points by selective energization of coils 75.

(2-2) Feed of Print Paper by a single dot-line

After the last dots have been printed and at the generation of timing pulse T30, print head 6 is moved back in the opposite direction to arrow A by lead 101b of the barrel cam. While this is occurring, print paper 95 is fed.

Figure 3:
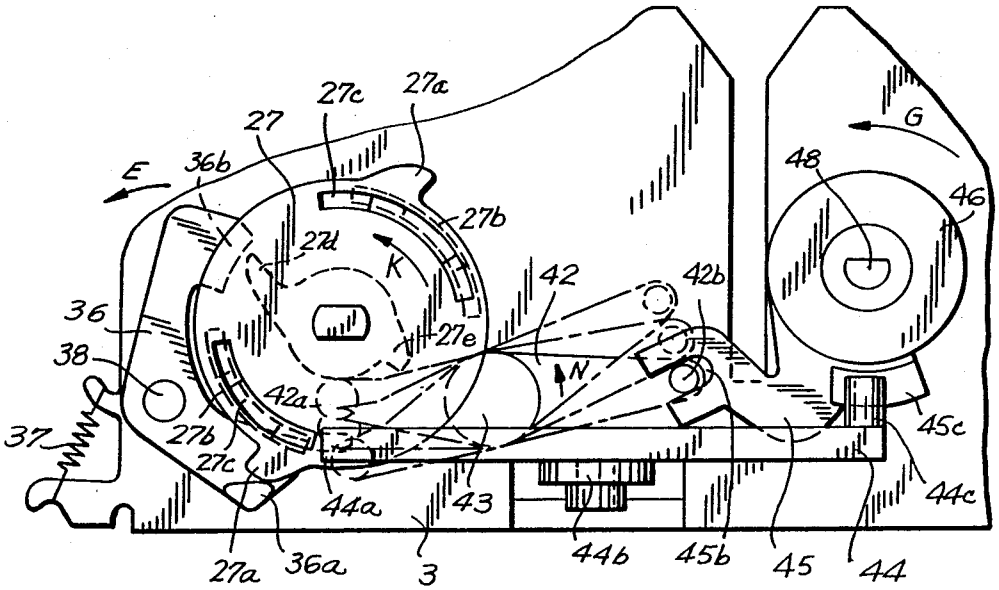
FIG. 3 is an elevational view of the paper feed mechanism of the printer of FIGS. 1 and 2.

As depicted in FIGS. 2 and 3, the rotation of paper feed cam 27 in the direction of arrow K causes one of cam portions 27e and 27d (FIG. 3) to push down on pin 42a of paper feed lever 42 which turns in the direction of arrow N so that paper feed drive gear 45, in engagement with pin 42b at slot 45b, is rotated in the opposite direction to arrow G. Then, ratchet teeth 45a and 46a (FIG. 2) are engaged, causing paper feed gear 46 to rotate in the direction opposite to arrow G, whereby print paper 95 is fed by paper feed roller 49. In the illustrated embodiment, paper feed cam portions 27e and 27d have leads for feeding paper in 1-dot and 3-dot pitches, respectively. However, in the usual manner of rotation of paper feed cam 27, the operation of portion 36b of paper feed cam lever 36 and cam portion 27b of paper feed cam 27 causes the paper feed cam to move axially on cam shaft 17, in the direction opposite to arrow C (away from the state in which cam 27d or 27e would engage pin 42a), so that cams 27d and 27e remain disengaged from pin 42a. Therefore, paper feed lever 42 does not operate and the rotation of paper feed cam 27 does not effect paper feed.

Upon energization of trigger coil 21 at trigger coil energization time 104a, trigger lever 24 rotates in the direction of arrow K and disengages from portion 36a of paper feed cam lever 36, allowing the lever to be turned in the direction of arrow E by spring 37. Accordingly, portion 36b of the cam lever escapes from the path of rotation of cam portion 27b of paper feed cam 27, allowing cam portion 27e to engage pin 42a of paper feed lever 42, thereby turning the lever in the direction of arrow N. As a result, paper feed drive gear 45, paper feed gear 46, and paper feed roller 49 are rotated in the opposite direction to arrow G, advancing print paper 95 by one dot-line. Once paper feed cam lever 36 has turned in the direction of arrow E, even if trigger coil 21 should be deenergized and trigger lever 24 should be turned in the opposite direction to arrow K by spring 25, trigger lever 24 remains in a standby condition, being only slightly rotated in the direction of arrow K by virtue of its abutment on cam lever portion 36*a* (see the corresponding two-dot-and-dash line in FIG. 4). Subsequent to the paper feed, paper feed cam lever 36 is turned in the opposite direction to arrow E, its portion 36*a* being pushed by reset cam 27*a* of paper feed cam 27, whereby portions 24*b* and 36*a* are engaged to each other and all members return to the initial position. Thus, the series of paper feed operations end.

In addition to causing trigger lever 24 to be disengaged from paper feed cam lever 36 for effecting paper feed, application of energization pulse 104*a* to trigger coil 21 also causes clutch lever 67 to turn in the opposite direction to arrow I (FIG. 4) so as to be disengaged from clutch plate 65. During this time, control lever 69 is brought into engagement with projection 65*b* of clutch plate 65 by the action (shown in FIG. 7 as control cam lead 112) of control cam 66*e* (FIG. 4) of clutch gear 66, preventing operation of clutch plate 65. Release lever cam 27*c* (release lever cam lead 110 in FIG. 7) and cam 27*b* (see cam lead 108) of paper feed cam 27 (FIG. 3) cause release lever 44, which is in standby condition, to constantly move paper feed drive gear 45 in the opposite direction to arrow F, e.g. out of engagement with paper feed gear 46, freeing paper feed roller 49 for rotation so that a print paper 95 may be easily removed.

Since paper feed cam 27 does not move in the thrust direction during the paper feed operation, cam portion 27*a* (cam lead 110*a*) causes release lever 44 to release paper feed drive gear 45 from its disengaged position (in the direction opposite to arrow F), allowing it to move in the direction of arrow F and into mesh with paper feed gear 46 for feeding the print paper.

(2-3) Feed of print paper by three dot-lines

The single dot-line print and single dot-line paper feed steps are repeated seven times to complete a character. Then, the print paper if fed by one space (three dot-lines in the illustrative embodiment) before printing the next character line.

Single dot-line paper feed maybe repeated three times in the aforementioned manner; however, such a way is time-consuming, so that total print speed is decreased. Therefore, a triple dot-line paper feed if performed in one operation.

The operation differs from single dot-line paper feed, in that trigger coil 21 is energized at the time of pulse 104*b* (FIG. 7). The operation of the respective members caused by the energization of trigger coil 21 is the same as described above, with the exception that trigger coil energization pulse 104*b* enables paper feed lever 42 to engage cam 27*d* (FIG. 3) which is so formed as to bring about a triple dot-line paper feed. Accordingly, triple dot-line paper feed is accomplished in one operation.

(3) Ribbon color change

The energization of trigger coil 21 at either time by pulses 111*a* or 111*b* switches ribbon color between red and black as described in "(1) Initial setting" by causing trigger lever 24 to turn and disengage from paper feed cam lever 36. The timing of pulses 111*a* or 111*b* is set to come after the end of the paper feed operation, so that paper feed is not effected even if paper feed cam lever 36 turns and paper feed cam 27 moves in the thrust direction.

The above operations are repeated in continuous printing.

Balancer 2 operates to prevent transmission of the rocking motion of print head 6 to the exterior of the printer. To this end, balancer gear 87 imparts motion to weight 89 which is in reverse phase, relative to the motion of the print head, so that the rocking effect of print head 6 is balanced and, therefore, not transmitted to the exterior of the printer.

In the foregoing first illustrative embodiment, the clutch mechanism is used for switching a ribbon color. In the below-described second illustrative embodiment, the clutch mechanism is used for feeding a card.

Figure 11:
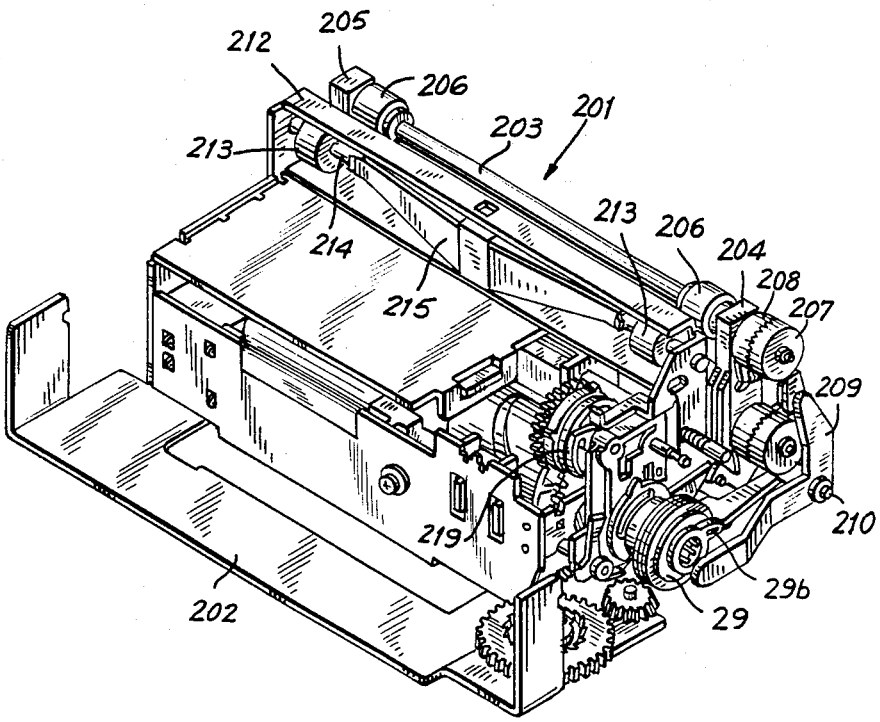
FIG. 11 is a perspective view of a printer using a power transmission apparatus in a second illustrative embodiment of the invention.
Figure 12:
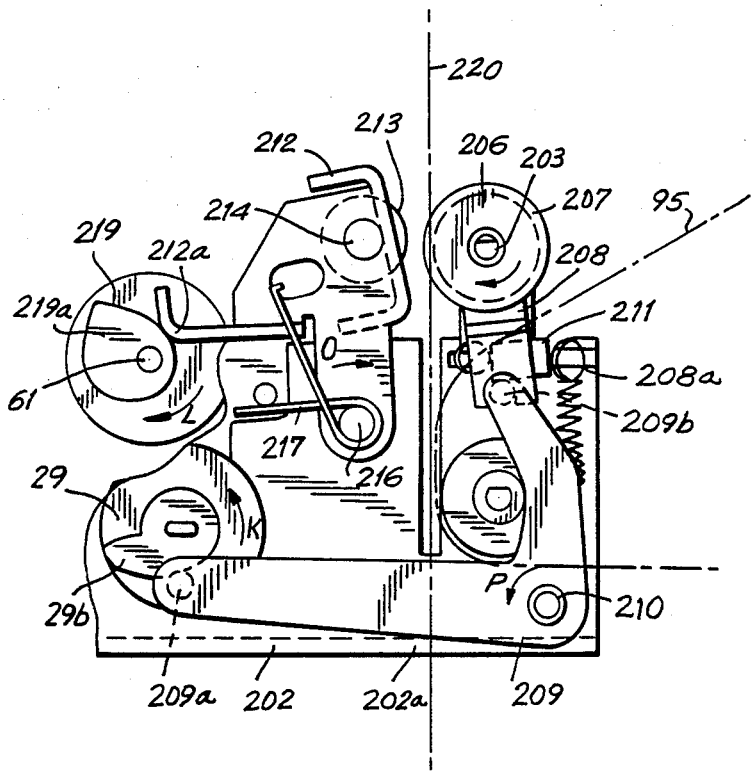
FIG. 12 is a partial elevational view of the power transmission apparatus of FIG. 11.

FIG. 11 is a perspective view of an entire printer having a card feeding mechanism and FIG. 12 is a side view of the card feeder mechanism itself. In this embodiment, the clutch mechanism which was used for switching ribbon color in the first embodiment, is used for causing a roller 213 to press a card 220 against a card feed roller 206 for feeding the card (FIG. 12) and for subsequently releasing the pressure.

A slot 202*a* (FIG. 12) is provided in the bottom of printer frame 202, extending between both side walls thereof (only sidewall 202*b* is detailed). Card 220 is set perpendicular to the bottom surface of frame 202. On one side of the position of card 220, the ends of a card feed shaft 203 are supported between a pair of sheet feed shaft supports 204, 205 (FIG. 11). A pair of card feed rollers 206 is mounted on card feed shaft 203, each roller being located just inside of a respective sheet feed shaft support 204, 205. A card feed drive gear 208 and a card feed gear 207 are also mounted, one behind the other, on card feed shaft 203, outside of sheet feed shaft support member 204.

Card pressure roller 213, a pressure roller shaft 214, and a card pressure plate 212 are disposed on the other side of the position of card 220. Card pressure roller 213 and its shaft 214 are supported for arcuate movement around a shaft 216, toward and away from card feed roller 206. Card pressure plate 212 is provided with a leaf-type pressure spring 215 (FIG. 11) which biases pressure plate 212 against roller shaft 214. The pressure roller assembly is biased away from card feed roller 206, in the opposite direction to arrow O (FIG. 12), by a spring 217. In the present embodiment a switch cam 219, similar to that which engages ribbon frame 4 for changing the ribbon color in the first embodiment, has a cam portion 219*a* which is in engagement with a cam follower portion 212*a* which extends to the rear of card pressure plate 212. A card feed lever 209 having first and second pins 209*a* and 209*b* at either end, is pivotally mounted on a shaft 210 which is secured to frame 202, and is biased in the opposite direction to arrow P by a spring 211 which is suspended below card feed drive gear 208 and exerts a biasing force on the latter in the opposite direction to arrow Q. Pin 209*a* is in engagement with a cam surface 29*b* (FIGS. 3, 11, 12) of ribbon drive gear 29, while pin 209*b* is engaged in a U-shaped slot 208*a* on the actuator arm which is attached to card feed drive gear 208.

The operation of the structure of the second embodiment is now described.

The manner of printing, ribbon feed, and paper feed is the same as previously described. Therefore, only the card feeding operation is described below.

During operation of the printer, ribbon drive gear 29 rotates in the direction of arrow K (FIG. 12) so that card feed lever 209 and card feed drive gear 208 are repeatedly rotated and restored by the actions of cam 29*b* and spring 211. Card feed drive gear 208, whose ratchet teeth are in engagement with those of card feed gear 207, changes the one-way rotation thereof into intermittent rotation of card feed gear 207 in the direction of arrow Q for rotating card feed rollers 206 intermittently. The amount of rotation produced corresponds to a single dot-line feed of card 220.

Upon insertion of card 202, trigger coil 21 is energized int he same way as described above in connection with the change of ribbon color, so that the clutch brings about rotation of switch cam 219 in the direction of arrow L. Accordingly, cam 219*a* moves card pressure plate 212 in the direction of arrow O so as to press card pressure roller 213 against card 220, thereby holding card 220 against card feed roller 206. Now card 220, interposed between card feed roller 206 and card pressure roller 213, is advanced by one dot-line by the intermittent rotation of card feed roller 206. Subsequent to the termination of printing on card 220, trigger coil 21 is reenergized, operating the clutch so as to disengage card pressure roller 213 from card feed roller 206 and return it to the standby position. This facilitates removal of card 220.

Even though card 220 and print paper 95 are loaded simultaneously, they can be fed independently at the same time.

It will be understood by those skilled in the art that the power transmission apparatus of this invention is not limited to the applications disclosed in the above-described embodiments, but that it is also useful in combination with a stamp drive, a cutter drive, or the like.

As described above, in the power transmission apparatus of the present invention, a single electromagnetic trigger member is driven at at least two times in one cycle of a print head's reciprocation to transmit power selectively and independently to a plurality of clutch mechanisms for control of paper feed, ribbon color change, card feed and so on, and the clutch mechanisms are prevented from operating by respective control members at other than predetermined drive times. Accordingly, the requisite number of costly and relatively large electromagnetic trigger members can be decreased in a given application. The power transmission apparatus of the invention thus provides a simplified structure, as well as one having reduced size and cost.

It will thus be seen that the objects set forth above, among those made apparent from the preceding description are efficiently attained and, since certain changes may be made in the above constructions without departing from the spirit and scope of the invention, it is intended that all matter contained in the above description or shown in the accompanying drawings shall be interpreted as illustrative and not in a limiting sense.

It will also be understood that the following claims are intended to cover all of the generic and specific features of the invention herein described and all statements of the scope of the invention which, as a matter of language, might be said to fall therebetween.

What is claimed is:

1. An apparatus for controlling the transmission of power from a continuously operating motor to at least a first device and a second device during an operating cycle, the apparatus comprising:

means for providing at least one first trigger signal and at least one second trigger signal during the operating cycle;

trigger means responsive to each first trigger signal at first predetermined periods of time in the operating cycle and to each second trigger signal at second predetermined periods of time in the operating cycle;

first control means coupled to the motor and responsive to the trigger means for transmitting said power to the first device at the first predetermined periods of time;

second control means coupled to the motor and responsive to the trigger means for transmitting said power to the second device at the second predetermined periods of time and including cam means and lever means; said lever means operable in response to the cam means at one of the first predetermined periods of time for preventing the transmission of said power to said second device and at one of the second predetermined periods of time for permitting the transmission of said power to said second device.

2. The apparatus of claim 1, wherein the second control means further includes clutch means having a rotational angle of 360° in the operating cycle which is divided between a smaller angle $\theta 1$ and a larger angle $\theta 2$, such that $\theta 1+\theta 2=360°/n$, n being a positive integer, wherein the time interval between the occurrence of the first and second trigger signals applied to the trigger means is longer than the time required for the clutch means to rotate through an angle $\theta 1$ and shorter than the time required for the clutch means to rotate through angle $\theta 2$, and wherein the length of time of each of said first and second trigger signals is less than the time required for the clutch means to rotate through the angle $\theta 1$.

3. The apparatus of claim 1, further including cam shaft means coupled to the motor and rotating once in the operating cycle; and switch clutch shaft means adjacent to the cam shaft means for supporting the second control means.

4. The apparatus of claim 3 further including, clutch lever shaft means located adjacent to the cam shaft means and to the switch clutch shaft means for supporting the lever means.

5. The apparatus of claim 1 wherein the trigger means is supported on the cam shaft means.

6. The apparatus of claim 4, wherein the second control means further includes clutch gear means rotatably supported on the switch clutch shaft means and operably coupled to the cam means for moving the lever means; and wherein the trigger means includes drive gear means on the cam shaft means and rotating therewith for driving the clutch gear means.

7. The apparatus of claim 6, wherein the second control means further includes clutch means rotatably supported on the clutch lever shaft means and operably engaged by the lever means.

8. The apparatus of claim 7, wherein the clutch means is engageable at at least two points and wherein the second control means further includes clutch lever means having a portion which is engageable with both points.

9. The apparatus of claim 8, wherein the clutch means further includes clutch plate means having a rotational angle of 360° which is divided between into a smaller angle $\theta 1$ and a larger angle $\theta 2$, such that $\theta 1+\theta 2=360°/n$, n being a positive integer, wherein the time interval between the occurrence of the first and second trigger signals applied to the trigger means is longer than the time required for the clutch means to rotate through angle $\theta 1$ and shorter than the time required for the clutch means to rotate through angle $\theta 2$, and wherein the length of time of each of said first and second trigger signals is less than the time required for the clutch means to rotate through angle $\theta 1$.

10. The apparatus of claim 7, wherein the second control means further includes switch cam means rotatably supported on the switch clutch shaft means for driving the second device; and means on the clutch means for coupling rotation of the clutch gear means to the switch cam means.

11. The apparatus of claim 10, wherein the means for coupling rotation from the clutch gear means to the switch cam means includes clutch pawl means having a pawl rotatably supported on the switch cam means and coupled to the clutch means for rotation therewith; at least one pawl on the clutch gear means; and torsion spring means coupling the clutch pawl means and the switch cam means for biasing the pawl on the clutch pawl means into engagement with the pawl on the clutch gear means.

12. The apparatus of claim 8, wherein the clutch lever means is supported on the clutch lever shaft means for rotary engagement with the clutch means to stop rotation thereof; and wherein the trigger means is mounted on the cam shaft and further including trigger lever means rotatably mounted on the cam shaft means and responding to energization of the trigger means by the second trigger signal to rotate the clutch lever means out of engagement with the clutch means.

13. The apparatus of claim 10, in which the second device is a ribbon color shift means, the ribbon color shift means being operably coupled to the switch cam means for changing the print color of the printer.

14. The apparatus of claim 10, in which the first device is a paper feed mechanism having pressure roller means operably coupled to the first control means, the first control means including paper feed cam means for operating the pressue roller means.

15. The apparatus of claim 7, in combination with a ribbon driving device and further including ribbon gear means rotatably coupled to the cam shaft means for driving a ribbon take-up shaft.

16. The apparatus of claim 15, in which the apparatus is a printer and in which the first device is a paper feed means which includes a paper feed cam means, the paper feed means operable for feeding paper to the printer.

17. The apparatus of claim 16, wherein the paper feed cam means is axially movable on the cam shaft means, and the paper feed means further comprises:

ratchet gear means for feeding the paper; and paper feed lever means coupled to the paper feed cam means for coupling reciprocating motion to the ratchet gear means.

18. The apparatus of claim 17, wherein the paper feed cam means comprises a plurality of cam surfaces, and wherein the paper feed means further includes paper feed cam lever means engaging a cam surface of the paper feed cam means for preventing engagement of the paper feed cam means with the paper feed lever means to inhibit the feeding of paper to the printer.

19. The apparatus of claim 18, wherein the trigger means is rotatably mounted on the cam shaft means, and further including trigger lever means operably coupled to the paper feed cam lever means for releasing the paper feed cam means from the paper feed cam lever means, thereby permitting engagement of the paper feed cam means with the paper feed lever means to effect paper feeding.

20. The apparatus of claim 16, wherein the paper feed cam means comprises first and second paper feed cam portions spaced apart about the axis of the paper feed cam means for feeding paper by differenct pitches.

21. A printer having at least a first device and a second device and an apparatus for controlling the transmission of power from a continuously operating motor to at least the first device and second device during an operating cycle, the apparatus comprising:

means for providing a first trigger signal and a second trigger signal during the operating cycle;

trigger means responsive to each first trigger signal at first predetermiend periods of time in the operating cycle and to each second trigger signal at second predetermined periods of time in the operating cycle;

first control means coupled to the motor and responsive to the trigger means for transmitting said power to the first device at the first predetermined periods of time;

second control means coupled to the motor and responsive to the trigger means for transmitting said power to the second device at the second predetermined periods of time and including cam means and lever means; said lever means operable in response to the cam means at one of the first predetermined periods of time for preventing the transmission of said power to said second device and at one of the second predetermined periods of time for permitting the transmission of said power to said second device.

22. The apparatus of claim 21, wherein the second control means further includes clutch means having a rotational angle of 360° in the operating cycle which is divided between a smaller angle $\theta 1$ and a larger angle $\theta 2$, such that $\theta 1+\theta 2=360°/n$, n being a positive integer, wherein the time interval between the occurrence of at least the first and second trigger signals applied to the trigger means is longer than the time required for the clutch means to rotate through angle $\theta 1$ and shorter than the time required for the clutch means to rotate through angle $\theta 2$, and wherein the length of time of each of said first and second trigger signals is less than the time required for the clutch means to rotate through the angle $\theta 1$.

* * * * *